US011814145B2

(12) United States Patent
Godoy

(10) Patent No.: US 11,814,145 B2
(45) Date of Patent: Nov. 14, 2023

(54) BACKREST FOR SCUBA DIVING WITH A SINGLE STRAP ADJUSTMENT SYSTEM

(71) Applicant: CRESSI-SUB S.P.A., Genoa (IT)

(72) Inventor: Carlos Alberto Godoy, Genoa (IT)

(73) Assignee: CRESSI-SUB S.P.A., Genoa (IT)

( * ) Notice: Subject to any disclaimer, the term of this patent is extended or adjusted under 35 U.S.C. 154(b) by 0 days.

(21) Appl. No.: 17/715,413

(22) Filed: Apr. 7, 2022

(65) Prior Publication Data

US 2022/0324545 A1 Oct. 13, 2022

(30) Foreign Application Priority Data

Apr. 9, 2021 (IT) ..... 102021000008921

(51) Int. Cl.
*B63C 11/22* (2006.01)
*B63C 11/02* (2006.01)

(52) U.S. Cl.
CPC ..... *B63C 11/02* (2013.01); *B63C 11/22* (2013.01); *B63C 2011/026* (2013.01)

(58) Field of Classification Search
CPC .... B63C 11/22; B63C 2011/026; B63C 11/02
USPC ..... 405/185–187; 224/627–628, 637, 660, 224/934
See application file for complete search history.

(56) References Cited

U.S. PATENT DOCUMENTS 3,174,664 A * 3/1965 Hue ..... B63C 11/30 224/604
3,957,183 A * 5/1976 Gadberry ..... B63C 11/02 224/628
D415,013 S * 10/1999 Griffiths ..... D8/354
8,398,337 B2 * 3/2013 Jablonski ..... B63C 11/02 224/660

FOREIGN PATENT DOCUMENTS

DE 19504545 A1 * 8/1996
EP 908383 A1 * 4/1999

* cited by examiner

*Primary Examiner* — Sunil Singh
(74) *Attorney, Agent, or Firm* — TROUTMAN PEPPER HAMILTON SANDERS LLP

(57) ABSTRACT

A backrest for scuba diving comprising a support element, a first strap strapping the support element to the diver's body and a second strap strapping an air cylinder to the support element. The support element has first slots passing the first strap and second slots passing the second strap. The first slots delimit a right portion and respectively a left portion of the first strap, independently adjustable over the right shoulder and right side and respectively over the left shoulder and left side of the diver. The support element comprises a support plate, a right angular profile having a first and second right wing, a right bracket supported by the first right wing, a left angular profile having a first and second left wing, a left bracket supported by the first left wing.

10 Claims, 6 Drawing Sheets

BACKREST FOR SCUBA DIVING WITH A SINGLE STRAP ADJUSTMENT SYSTEM

CROSS REFERENCE TO RELATED APPLICATION

This application claims benefit of priority to Italian Patent Application No. 102021000008921, filed Apr. 9, 2021. The entire contents of which are hereby incorporated by reference.

FIELD OF THE INVENTION

The present invention relates to a backrest for scuba diving.

BACKGROUND

Backrests for scuba diving, that is, back support elements for one or more air cylinders for scuba diving, have been present on the market for some time in an extreme variety of shapes and sizes, both in a simple configuration and in a configuration integrated into a buoyancy control device (BCD), and are constrained to the diver's body in various ways, generally with flexible straps.

It is well known that a plurality of straps and a corresponding plurality of connections and closures are generally interpreted by a scuba diver as an annoyance during donning and even more so during doffing, which, under emergency conditions, may need to be simple and fast. As is known, there are backrests for scuba divers on the market which are provided with a single strap for constraining them to the diver's body, and in which the strap, in a first upper part thereof, acts as a support for the weight of the cylinder(s) on the diver's shoulders and, in a second part thereof, suitably routed, allows a coupling of the two ends in an abdominal position.

Such constraint systems are notoriously scarcely effective, since the release of the second abdominal part of the strap corresponds to a release of the first part of the strap over the diver's shoulders, with a consequent release of the backrest bearing the weight of the cylinder(s), if it is not immediately held up by the diver.

A need is thus felt to improve the structure of the known backrests for scuba diving. The technical task of the present invention, therefore, is to provide a backrest for scuba diving that enables the aforementioned technical drawbacks of the prior art to be eliminated.

Within the scope of this technical task, one object of the invention is to provide a backrest for scuba diving constrained to the diver's body with a single strap, in a simple and effective manner.

Another object of the invention is to provide a backrest for scuba diving in which the release of the single strap constraining in the abdominal position maintains the constraint of the backrest on the diver's shoulders.

Yet a further object of the invention is to provide a backrest for scuba diving in which the release of the constraint on the diver's shoulders is extremely simple and obtained by virtue solely of the natural and instinctive pulling of the single constraining strap by the diver.

The technical task, as well as these and other objects, are achieved according to the present invention by providing a backrest for scuba diving comprising a support element, a first strap for constraining said support element to the diver's body and at least a second strap for constraining at least one air cylinder to said support element, said support element having first slots for the passage of the first strap and second slots for the passage of the second strap, said first slots delimiting a right portion and respectively a left portion of said first strap, independently adjustable over the right shoulder and right side and respectively over the left shoulder and left side of the diver, wherein said support element comprises a support plate, a right angular profile having a first right wing and a second right wing, a right bracket supported by said first right wing of said right angular profile, a left angular profile having a first left wing and a second left wing, and a left bracket supported by said first left wing of said left angular profile, said first slots comprising a first lower right slot fashioned on said right bracket and facing said second right wing and a first lower left slot fashioned on said left bracket and facing said second left wing.

Other features of the present invention are defined, moreover, in the subsequent claims.

BRIEF DESCRIPTION OF THE DRAWINGS

Additional features and advantages of the invention will become more apparent from the description of a first preferred but not exclusive embodiment of the backrest for scuba diving according to the invention, illustrated by way of non-limiting example in the appended drawings, in which.

DETAILED DESCRIPTION

Figures 1, 2:
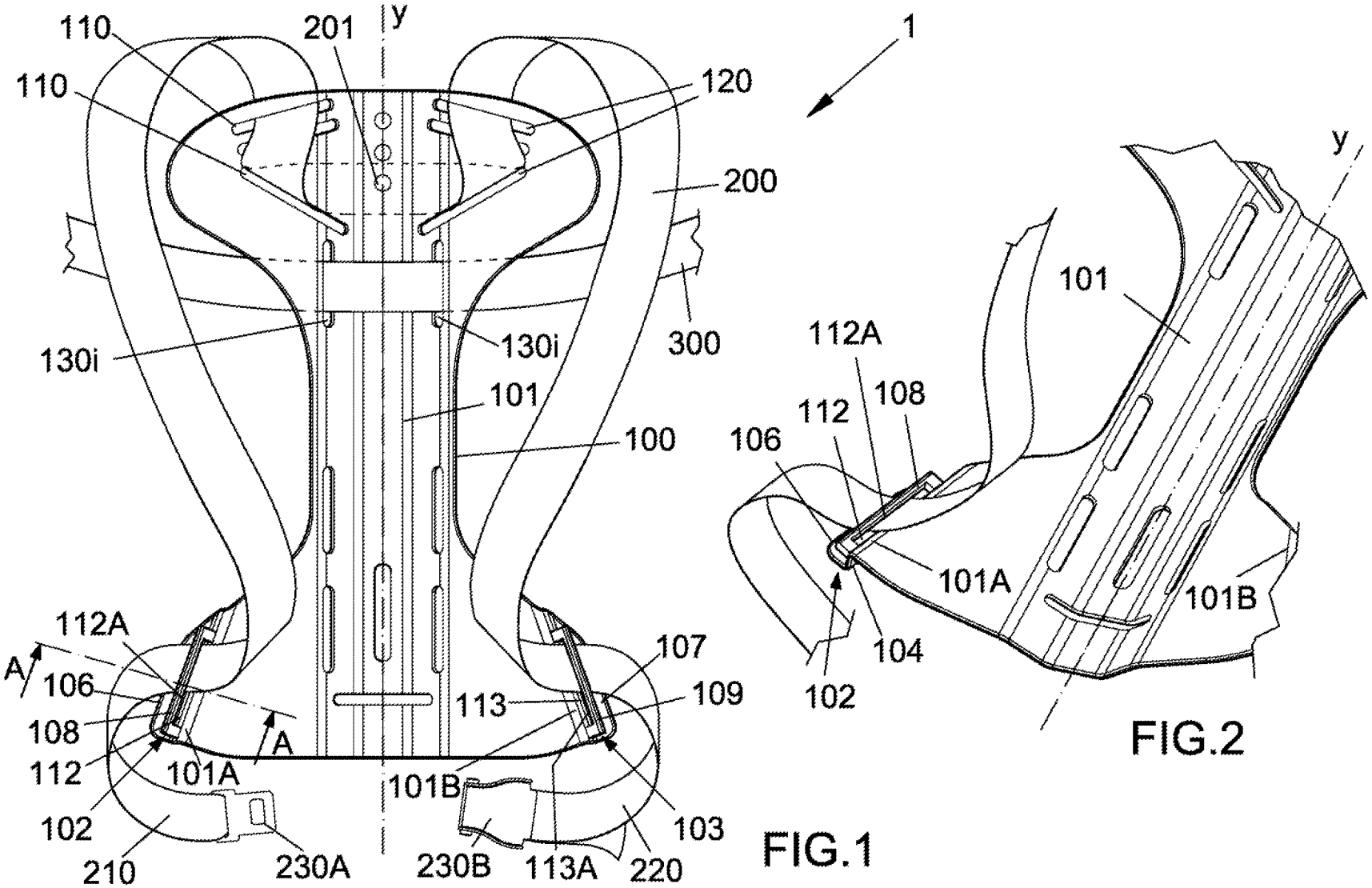
FIG. 1 shows an overall front view of the backrest and of the constraining strap in the rest position.
FIG. 2 shows a detailed view of the right wing of the backrest, with the constraining strap in the rest position.
Figure 1A:
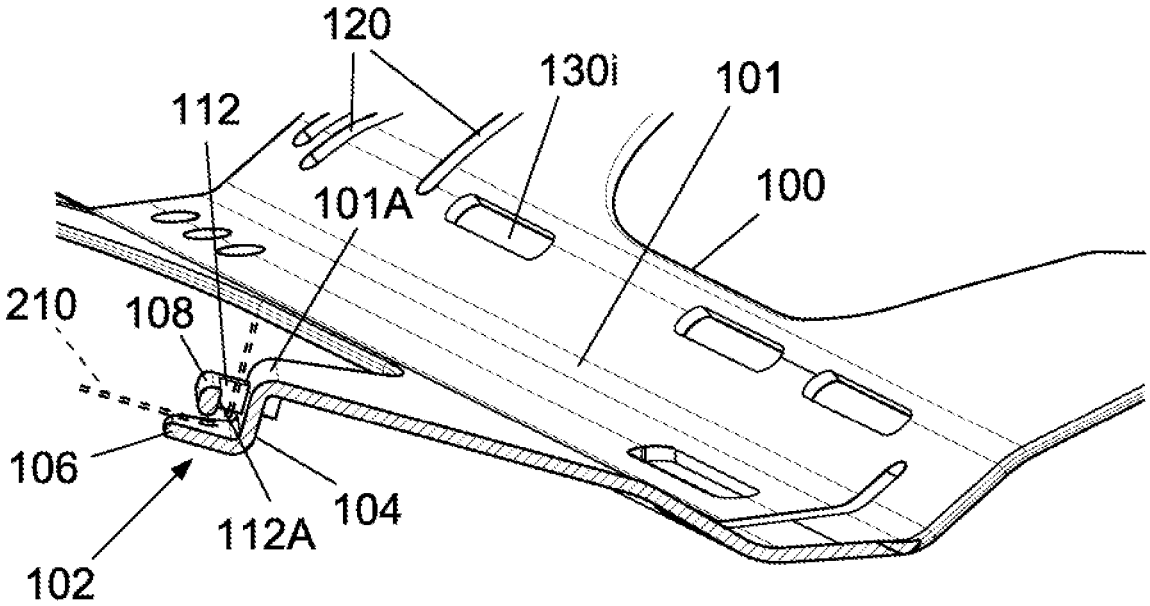
FIG. 1*a* shows a section of the backrest along the line A-A in FIG. 1.
Figure 10B:
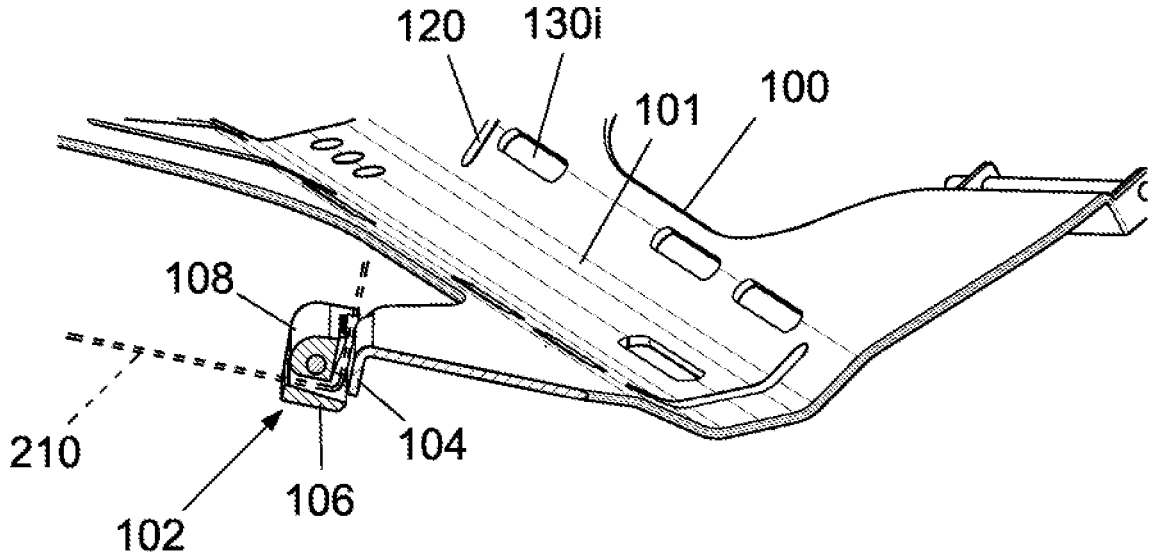
FIG. 10*b* shows a section of the backrest along the line B-B in FIG. 10.
Figure 4:
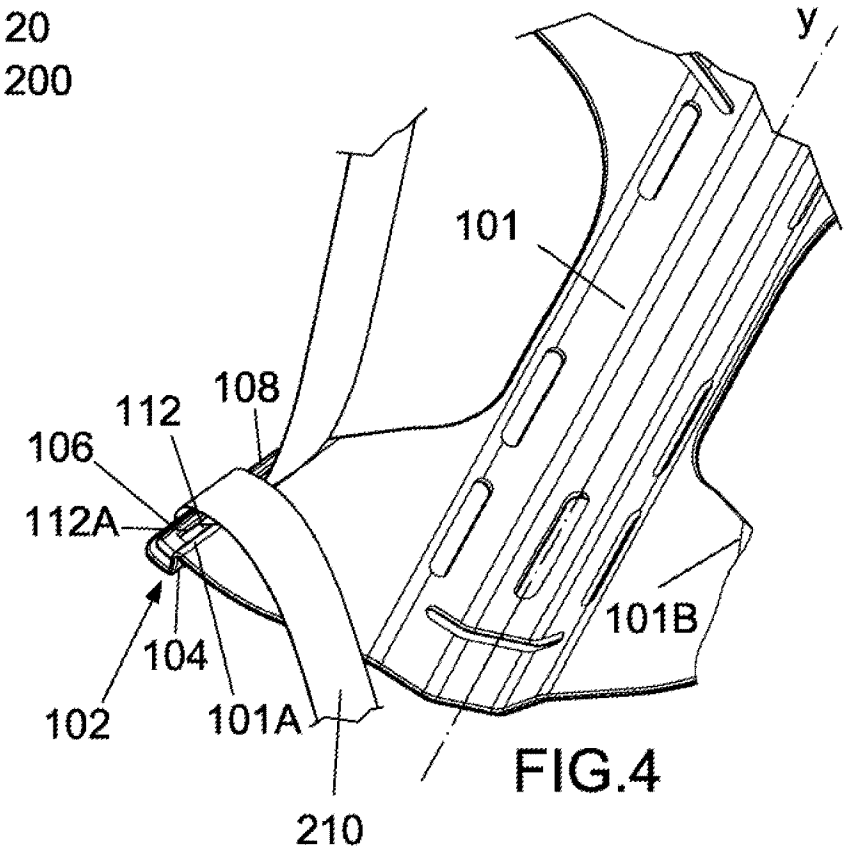
FIG. 4 shows a detailed view of the right wing of the backrest, with the constraining strap in the constraining position.
Figure 3:
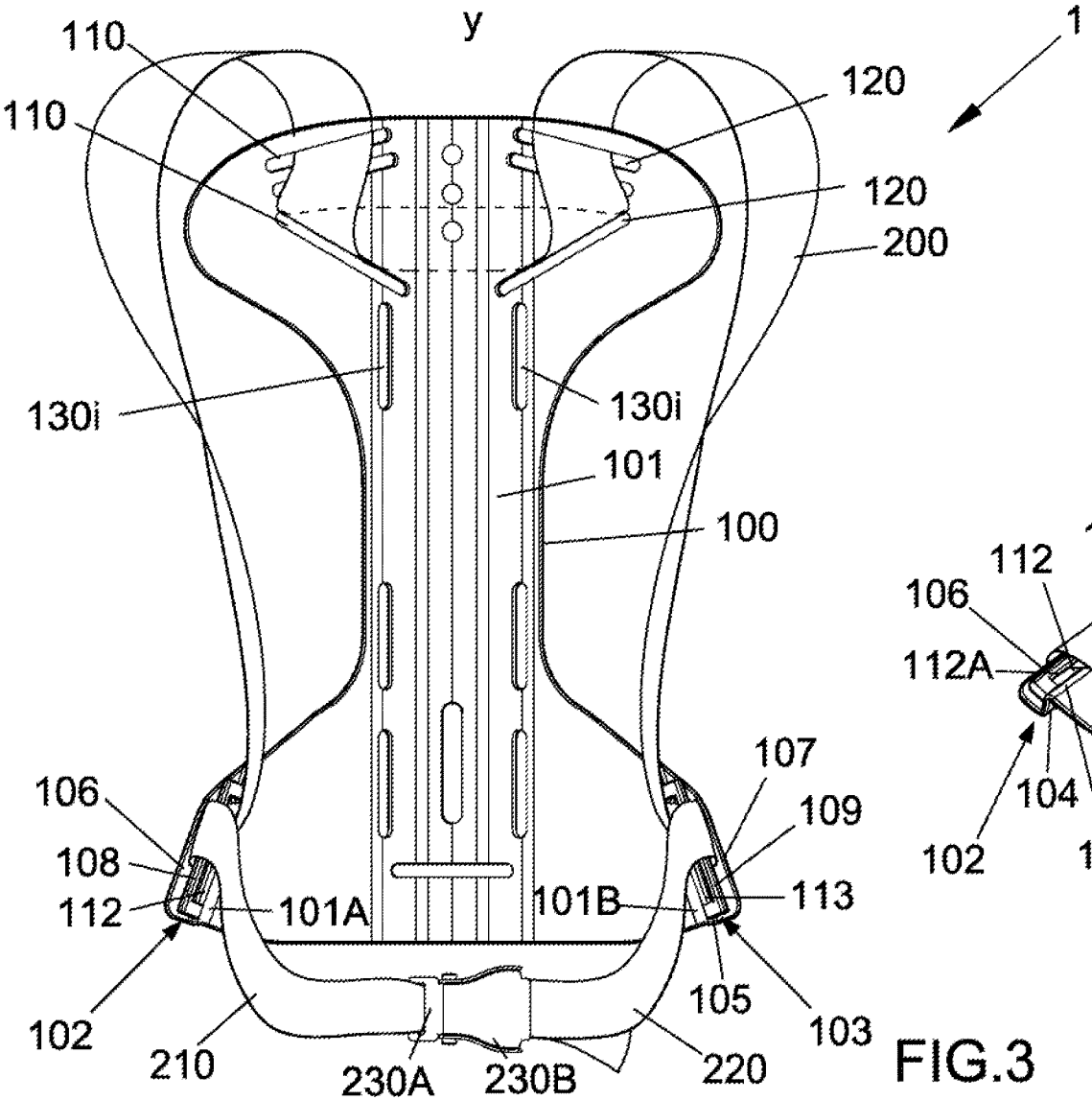
FIG. 3 shows an overall front view of the backrest and of the constraining strap in the constraining position.
Figures 5, 6:
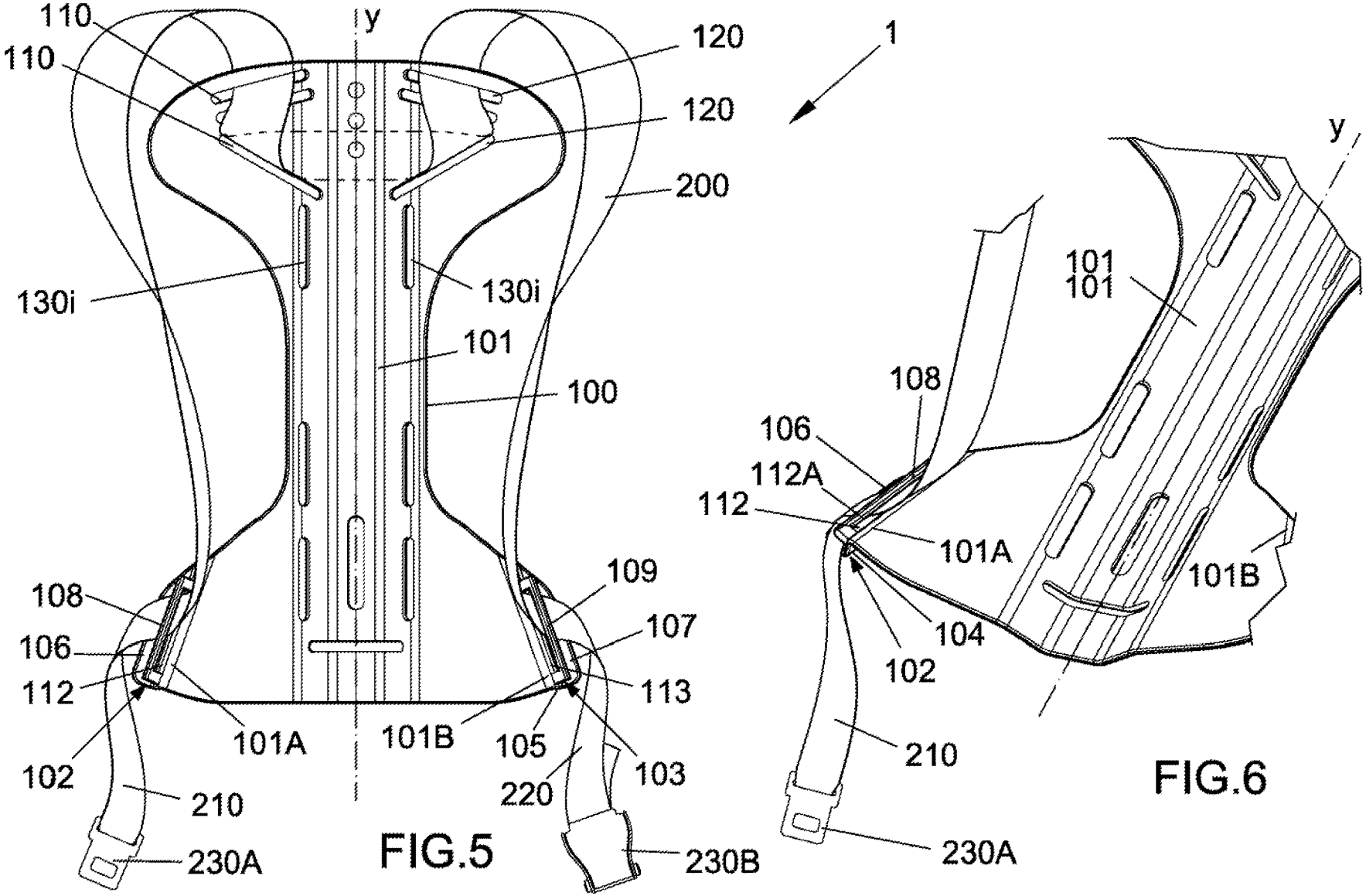
FIG. 5 shows an overall front view of the backrest and of the constraining strap in the abdominal release position.
FIG. 6 shows a detailed view of the right wing of the backrest, with the constraining strap in the abdominal release position.
Figures 7, 8, 9:
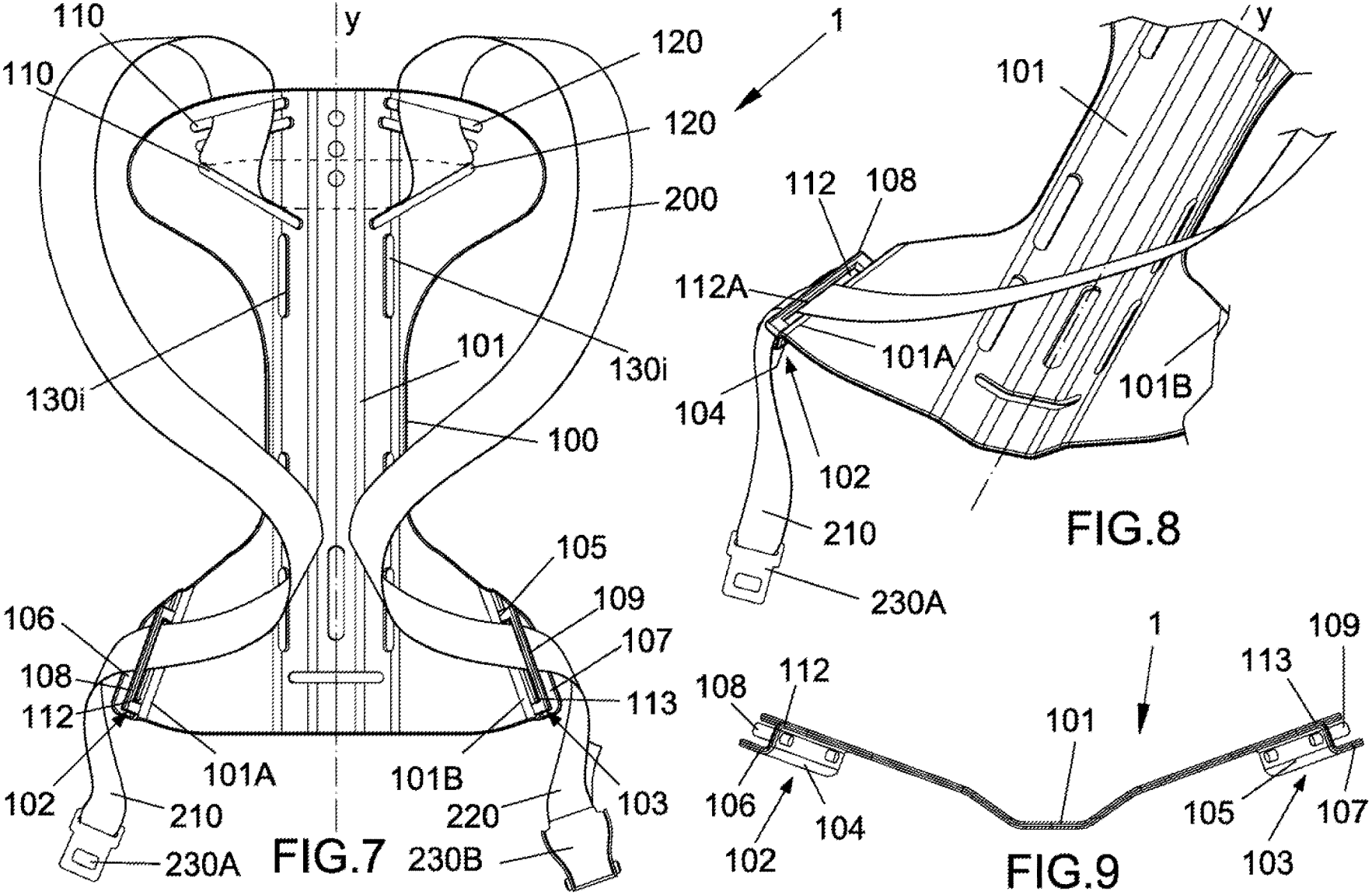
FIG. 7 shows an overall front view of the backrest and of the constraining strap in the dorsal release position.
FIG. 8 shows a detailed view of the right wing of the backrest, with the constraining strap in the dorsal release position.
FIG. 9 shows a bottom view of the support element of the backrest.

With reference to the above-mentioned figures, they show a backrest for scuba diving denoted in its entirety by the reference number 1.

The backrest for scuba diving 1 comprises at least one support element 100, at least a first strap 200 for constraining the support element 100 to the diver's body and at least a second strap 300 for constraining at least one air cylinder (not shown in the figures, for the sake of simplicity of illustration) to the support element 100.

The support element 100 has first slots 110, 112 and 120, 113 for the passage of the first strap 200 and second slots 130*i* for the passage of the second strap 300.

The first slots 110, 112 delimit a right portion 210 and the first slots 120, 113 respectively delimit a left portion 220 of the first strap 200.

The right portion 210 and left portion 220 are independently adjustable, respectively over the right shoulder and right side and over the left shoulder and left side of the diver.

Conveniently, the right portion 210 and the left portion 220 of the first strap 200 have reversible adjustable abdominal reciprocal blocking means 230 A and 230 B at the respective ends thereof. These are illustrated as a latch plate 230 A and a buckle 230 B.

The support element 100, variously configured but typically symmetric with respect to the vertical central axis of symmetry Y, comprises a support plate 101 and a right angular profile 102 having a first right wing 104, a second right wing 106 and a right bracket 108 supported by the first right wing 104 for connecting with the second right wing 106.

The support plate 101 symmetrically comprises a left angular profile 103 having a first left wing 105 and a second left wing 107 and a left bracket 109 supported by the first left wing 105 for connecting with the second left wing 107.

The first slots 110, 112 comprise a first lower right slot 112 fashioned on the right bracket 108 and facing second right wing 106.

Symmetrically, the first slots 120, 113 comprise a first lower left slot 113 fashioned on the left bracket 109 and facing the second left wing 107.

Conveniently, the first lower right slot 112 and the first lower left slot 113 are inclined from bottom to top in the direction of the vertical central axis of symmetry Y.

Conveniently, the first lower right slot 112 and the first lower left slot 113 have a respective sharp edge 112 A and 113 A, configured to block respectively the right portion 210 and the left portion 220 of the first strap 200 under tension.

The right angular profile 102 and the left angular profile 103 extend respectively from a lower right lateral edge 101 A and from a lower left lateral edge 101 B of the support plate 101.

The first right wing 104 extends substantially orthogonally from the lower right lateral edge 101 A of the support plate 101 and the first left wing 105 extends substantially orthogonally from the lower left lateral edge 101 B of the support plate 101.

The second right wing 106 extends rearwardly and substantially orthogonally from the first right wing 104, and the second left wing 107 extends rearwardly and substantially orthogonally from the first left wing 105.

Relative to the first right wing 104, the second right wing 106 extends on the side opposite to the support plate 101, and relative to the first left wing 105 the second left wing 107 extends on the side opposite to the support plate 101.

The second right wing 106 defines an angle return section for the right portion 210 of the first strap 200, and the second left wing 107 defines an angle return section for the left portion 220 of the first strap 200.

Advantageously, the angle return section imparts a 90° angle to the right portion 210 and to the left portion of the first strap 200.

Advantageously, in a preferred embodiment illustrated in FIGS. 1-9, the support plate 101, the right angular profile 102 and the left angular profile 103 are made in one piece.

Figure 11:
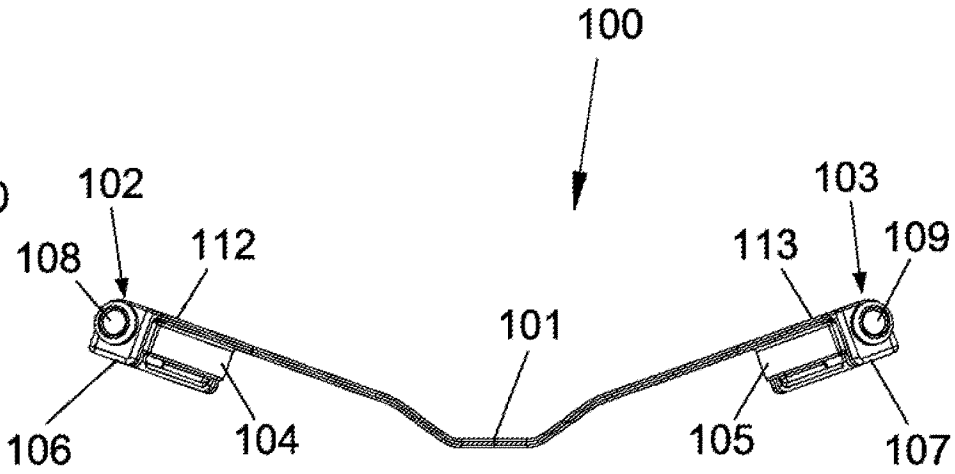
FIG. 11 shows a bottom view of the support element of the backrest in a second embodiment.
Figure 10:
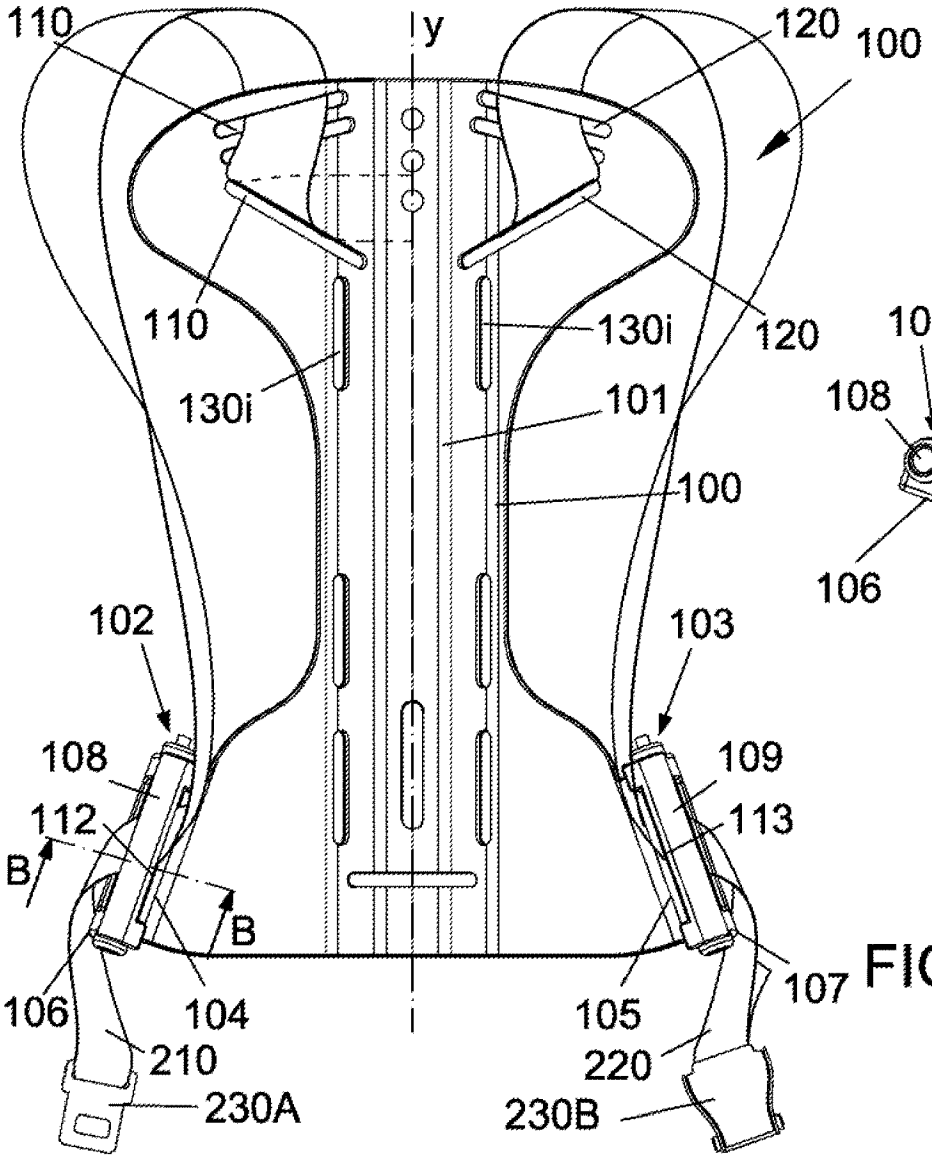
FIG. 10 shows an overall front view of the backrest in a second embodiment.

In a second preferred embodiment illustrated in FIGS. 10 and 11, the right angular profile 102 and the left angular profile 103 are structurally independent pieces fixed to the support plate 101.

The functioning of the backrest for scuba diving according to the invention appears clear from what has been described and illustrated and, in particular, it is substantially the following.

The first strap 200 is blocked at the top and centrally, with respect to its length, to the support plate 101 by suitable constraining means 201, for example a bolt, on the vertical central axis of symmetry Y; the right portion 210 is engaged in the first slots 110, 112 and the left portion 220 is engaged in the first slots 120, 113.

The part of the right portion 210 substantially comprised between the constraining means 201 and the lower right slot 112 constitutes the right shoulder strap of the backrest 1, and the part of the left portion 220 substantially comprised between the constraining means 201 and the lower left slot 113 constitutes the left shoulder strap of the backrest 1.

The part of the right portion 210 substantially comprised between the lower right slot 112 and the reversible adjustable abdominal reciprocal blocking means 230 A, and the part of the left portion 220 substantially comprised between the lower left slot 113 and the reversible adjustable abdominal reciprocal blocking means 230 B constitute the abdominal constraint of the backrest 1 to the diver's body.

Donning of the backrest 1 typically takes place in two steps.

For the first donning step, the diver engages his right shoulder in the right shoulder strap and his left shoulder in the left shoulder strap; then, with a single action of pulling on the free ends of the right portion 210 and of the left portion 220 of the strap 200, the diver tautens the right and left shoulder straps, respectively.

The advantageous configuration of the lower right slot 112 with the sharp edge 112 A and the 90° angle return section defined by the second right wing 106 block, under tension, the right portion 210 of the first strap 200 constituting the right shoulder strap of the backrest 1, preventing the release thereof.

Analogously and symmetrically, the advantageous configuration of the lower left slot 113 with the sharp edge 113 A and the 90° angle return section defined by the second left wing 108 block, under tension, the left portion 220 of the first strap 200 constituting the left shoulder strap of the backrest 1, preventing the release thereof.

With the first donning step, the diver securely fixes backrest 1, with the associated load of the air cylinder(s), on his shoulders.

In the second donning step, which can be directly sequential or also at a later moment than the first step, the diver adjusts the abdominal constraint with a single action of pulling on the free ends of the right portion 210 and of the left portion 220 of the strap 200, securing them reciprocally around his body with the reversible adjustable abdominal reciprocal blocking means 230 A and 230 B.

The backrest 1 is thus securely fixed to the diver's shoulders and waist.

As in the case of donning, doffing typically takes place in two steps.

In a first doffing step, the diver releases the reversible adjustable abdominal reciprocal blocking means 230 A and 230 B.

Upon the release of the reciprocal constraint, the free ends of the right portion 210 and of the left portion 220 of the first strap 200 can be allowed to drop freely from the diver.

Advantageously, in fact, and innovatively, according to the present invention, the 90° angle return for the right portion 210 defined by the second right wing 106, and 90° angle return for the left portion 220 defined by the second left wing 107 maintain the right portion 210 constituting the right shoulder strap and the left portion 220 constituting the left shoulder strap of the backrest 1, respectively, under tension, preventing the release thereof.

In the second doffing step, the diver grasps the shoulder straps with his hands and, with an instinctive and natural movement, pushes on the right portion 210 and left portion 220, moving them away from his body.

The movement away from the body modifies the passage and engagement angle of the strap portions through the lower right slot 112 and the lower left slot 113; the sharp edge 112 A and the sharp edge 113 A are disengaged from their engagement with the respective strap portions 210 and 220, allowing the sliding thereof in the lower slots 112 and 113 and thus the lengthening of the shoulder straps.

With the shoulder straps lengthened and no longer adherent to his chest, the diver is thus in a condition to free his shoulders and doff the backrest 1, with the associated load of the air cylinder(s).

It has in practice been ascertained that a backrest for scuba diving according to the invention is particularly advantageous because of the ease and simplicity of donning with a single strap, in a simple and effective manner.

Another advantage of the invention is that of providing a backrest for scuba diving in which the release of the single constraining strap in the abdominal position maintains the constraint of the backrest on the diver's shoulders.

Yet a further advantage of the invention is that of providing a backrest for scuba diving in which the release of the constraint on the diver's shoulders is extremely simple and obtained by virtue solely of the natural and instinctive pulling of the single constraining strap by the diver.

A backrest for scuba diving thus conceived is susceptible of numerous modifications and variants, all falling within the scope of the inventive concept, as defined by the claims; moreover, all the details may be replaced with technically equivalent elements.

The materials used, as well as the dimensions, may in practice be any whatsoever according to needs and the state of the art.

The invention claimed is:

1. A backrest for scuba diving comprising:

a support element having a front side, a first strap configured to constrain said support element to a diver's body; and a second strap constraining at least one air cylinder to said support element, wherein said support element comprises:

first slots for the passage of said first strap, and second slots for the passage of said second strap, wherein said first slots delimiting a right portion and respectively a left portion of said first strap, independently adjustable over the right shoulder and right side and respectively over the left shoulder and left side of the diver, wherein said support element further comprises:

a support plate, a right angular profile comprising a first right wing and a second right wing, a right bracket supported by said first right wing of said right angular profile, a left angular profile comprising a first left wing and a second left wing, a left bracket supported by said first left wing of said left angular profile, wherein said first slots comprising:

a first lower right slot fashioned on said right bracket and facing said second right wing, the first strap passing through the first lower right slot such that the first strap is disposed on the front side of the support element at terminal ends of the first lower right slot, and a first lower left slot fashioned on said left bracket and facing said second left wing, the first strap passing through the first lower left slot such that the first strap is disposed on the front side of the support element at terminal ends of the first lower left slot, wherein said right angular profile and respectively said left angular profile extend from a lower right lateral edge and respectively from a lower left lateral edge of said support plate, said first right wing extends substantially orthogonally from said lower right lateral edge of said support plate, said first left wing extends substantially orthogonally from said lower left lateral edge of said support plate, said second right wing extends rearwardly and substantially orthogonally from said first right wing, and said second left wing extends rearwardly and substantially orthogonally from said first left wing.

2. The backrest for scuba diving according to claim 1, wherein relative to said first right wing said second right wing extends on a first side opposite to said support plate, and relative to said first left wing said second left wing extends on a second side opposite to said support plate.

3. The backrest for scuba diving according to claim 1, wherein said second right wing defines an angle return section for said right portion of said first strap, and said second left wing defines an angle return section for said left portion of said first strap.

4. The backrest for scuba diving according to claim 3, wherein said angle return sections imparts a 90° angle.

5. The backrest for scuba diving according to claim 1, wherein said support element has a vertical central axis of symmetry and said first lower right slot and said first lower left slot are inclined from bottom to top in the direction of said vertical axis of symmetry.

6. The backrest for scuba diving according to claim 1, wherein said support plate and said right angular profile and said left angular profile are made in one piece.

7. The backrest for scuba diving according to claim 1, wherein said right angular profile and said left angular profile are structurally independent pieces fixed to said support plate.

8. The backrest for scuba diving according to claim 1, wherein said first lower right slot and said first lower left slot have a respective lower right slot sharp edge and a lower left slot sharp edge.

9. The backrest for scuba diving according to claim 8, wherein said lower right slot sharp edge and said lower left slot sharp edge respectively block said right portion and said left portion of said first strap under tension.

10. The backrest for scuba diving according to claim 1, wherein said right portion and said left portion of said first strap have reversible adjustable abdominal reciprocal buckle and latch plate at the respective ends thereof.

* * * * *